US007921936B2

(12) United States Patent
Cavanough

(10) Patent No.: US 7,921,936 B2
(45) Date of Patent: Apr. 12, 2011

(54) METHOD AND SYSTEM FOR CONTROLLING AN EXCAVATING APPARATUS

(75) Inventor: Gary Lindsay Cavanough, Pullenvale (AU)

(73) Assignee: Commonwealth Scientific and Industrial Research Organisation, Campbell (AU)

( * ) Notice: Subject to any disclaimer, the term of this patent is extended or adjusted under 35 U.S.C. 154(b) by 346 days.

(21) Appl. No.: 11/885,082

(22) PCT Filed: Feb. 24, 2006

(86) PCT No.: PCT/AU2006/000241

§ 371 (c)(1),
(2), (4) Date: Mar. 7, 2008

(87) PCT Pub. No.: WO2006/089367

PCT Pub. Date: Aug. 31, 2006

(65) Prior Publication Data

US 2009/0114444 A1 May 7, 2009

(30) Foreign Application Priority Data

Feb. 25, 2005 (AU) ..... 2005900871

(51) Int. Cl.
*E21B 44/00* (2006.01)

(52) U.S. Cl. ..... 175/24; 175/25

(58) Field of Classification Search ..... 175/24, 175/25, 27, 40
See application file for complete search history.

(56) References Cited

U.S. PATENT DOCUMENTS

| | | | | |
|---|---|---|---|---|
| 3,971,449 | A | 7/1976 | Nylund et al. | |
| 5,449,047 | A | 9/1995 | Schivley, Jr. | |
| 5,458,207 | A * | 10/1995 | Mattero | 175/27 |
| 6,216,800 | B1 * | 4/2001 | Wilson et al. | 175/27 |
| 7,604,070 | B2 * | 10/2009 | Kemppainen | 173/1 |

OTHER PUBLICATIONS

International Search Report issued by the International Searching Authority (ISA/AU) on Mar. 27, 2006 in connection with International Application No. PCT/AU2006/000241.
WO 1997/008428 A1 (Atlas COPCO Craelius AB) Mar. 6, 1997.
WO 1992/012329 A1 (Tamrock Oy) Jul. 23, 1992.

* cited by examiner

*Primary Examiner* — William P Neuder
(74) *Attorney, Agent, or Firm* — John P. White; Cooper & Dunham LLP

(57) ABSTRACT

A method for controlling a drilling apparatus comprising the steps of applying a rotation force to a drilling part of the drilling apparatus, applying a feed force to the drilling part with the feed force comprising a predetermined modulating frequency signal and predetermined feed force, wherein optimum predetermined feed force is determined periodically from sensed data relating to at least one of the rotation force and feed force to optimise the penetration rate of the drilling apparatus.

14 Claims, 4 Drawing Sheets

METHOD AND SYSTEM FOR CONTROLLING AN EXCAVATING APPARATUS

This application is a §371 national stage of PCT International Application No. PCT/AU2006/000241, filed Feb. 24, 2006, and claims priority of Australian Patent Application No. 2005900871, filed Feb. 25, 2005, the contents of all of which are hereby incorporated by reference into this application.

FIELD OF THE INVENTION

The invention relates to the mining and construction industry and is particularly concerned with drilling apparatuses.

BACKGROUND OF THE INVENTION

Present mining methods involve the use of a combination of apparatuses to drill holes in rock, place explosives in the hole and then initiate the explosives to fracture the rock.

A typical drilling apparatus for such purposes is controlled by a motor which applies rotation torque to the drilling head of the apparatus and a mechanism to apply a forward force to the drilling head. The means for applying torque and force may be one or a combination of hydraulic motor or cylinder, pneumatic motor or cylinder, or electric motor. Various mechanisms are used to couple the source of torque or force to the drilling head including use of chains, rope or gears or leavers.

In any drilling operation it is desirable to maximise the rate of penetration of rock which is drilled while maintaining hole accuracy. However this is a difficult objective and to date has not been successfully achieved. Thus although for a given type of rock or material which is being drilled, there is an optimum feed force for a given rotation torque, no apparatus has been developed which successfully controls the drill to ensure a continuous maximum penetration rate of rock throughout the length of hole.

The present invention provides a method and system for controlling a drilling apparatus to enhance penetration rates during drilling operations.

It should be understood that drilling apparatuses are intended to cover different types of cutting apparatuses for excavating material such as rock in mining or other applications such as percussive and rotary drills.

SUMMARY OF THE INVENTION

According to a first aspect of the present invention there is provided a method for controlling a drilling apparatus comprising the steps of applying a rotation torque to a drilling part of the drilling apparatus, applying a feed force to the drilling part with the feed force comprising a predetermined modulating frequency signal and predetermined feed force, wherein the optimum predetermined feed force is determined periodically from sensed data relating to either the rotation torque or feed force to optimise the penetration rate of the drilling apparatus.

Preferably the optimum predetermined feed force is determined from the rotation torque alone or the feed force alone.

The optimum predetermined feed force preferably includes a feed force falling within an optimum range of feed forces.

The predetermined modulating frequency signal preferably has a constant amplitude.

The method may include the step of combining the predetermined modulating frequency with the optimum predetermined frequency.

Preferably the method includes providing a controller to calculate the optimum predetermined frequency.

Where the feed force is applied by hydraulic or pneumatic means, the method may include the step of providing a pressure control valve to control feed force applied to the drilling part. In that case, the feed force is controlled by and referred to as a feed pressure.

Where the rotational torque is applied by hydraulic or pneumatic means, preferably the method includes providing a flow control valve to control rotation pressure applied to the drilling part. In that case, the rotational torque is controlled by and referred to as a rotational pressure.

The sensed data may include the demodulated modulating frequency from the sensed rotation pressure.

Preferably the pressure valve controls at least one feed ram, chain or rope.

Preferably the flow valve controls at least one motor.

It is preferred that the drilling apparatus includes one or more rams or motors.

Preferably the apparatus includes feed mechanisms such as ram(s) and motor(s) as well respectively.

The apparatus may comprise a control chain or electric motor.

The method may include a plurality of pressure valves and flow valves and transducers for measuring and controlling the feed ram(s) and motor(s) respectively.

According to one embodiment the method includes the step of varying the amplitude of the modulating frequency signal.

The method may include the step of applying an incremental change to the feed pressure based on the sensed rotation pressure.

Preferably the incremental change is selected to reduce the difference between the sensed rotation pressure and the optimum rotation pressure.

The incremental change may be selected to reduce the difference in feed pressure from optimum feed pressure.

Preferably the method includes the step of storing data in the controller relating to optimum feed pressure and rotation pressure for a predetermined material being cut.

It is preferred that the method includes storing data in a controller relating to optimum feed pressure and rotation pressure for a given type of drilling apparatus or part of the drilling apparatus.

The method may include the step of storing comparative data such as graphical data relating to rotation pressure versus feed pressure and penetration rate versus feed pressure and/or rotation pressure for:

a. different materials (rock, minerals etc.); or b. different drill parts/types.

The feed pressure may be changed periodically by an incremental value between upper and lower range limits.

The upper and lower range limits are preferably + or −15% of the feed pressure.

It is preferred that the method includes the step of sampling the rotation pressure at a sampling rate greater than the modulation frequency.

The sampling rate is preferably at least 20 times the modulation frequency to cope with noise levels.

According to another aspect of the present invention there is provided a system for controlling a drilling apparatus comprising a rotation pressure sensor to sense rotation pressure on the drilling apparatus, a feed pressure sensor to sense feed pressure on the drilling apparatus, a controller which controls at least one of the rotation pressure or feed pressure applied to the drilling apparatus and a modulating means which applies a predetermined modulating frequency signal to at least one of the rotation pressure or feed pressure, whereby the controller periodically alters the feed pressure to optimise the penetration rate of the drilling apparatus based on data sensed by at least one of the rotation pressure or feed pressure sensor.

Preferably the controller includes a demodulation algorithm to extract the rotation pressure from the rotation pressure sensor.

The controller may determine the optimum feed pressure from the sensed rotation pressure.

The rotation pressure sensor may have a sampling rate which is at least 20 times the modulating frequency.

Preferably the modulation frequency is determined based on constants of the drill control system.

The sampling rate may be set to minimise noise interference.

Preferably the system includes a rotation pressure controller which controls rotation pressure of the drilling apparatus.

The rotation pressure controller may comprise a flow control valve.

The rotation pressure controller preferably controls a motor such as a drill rotation motor.

The system may include a feed pressure controller which controls feed pressure of the drilling apparatus.

The feed pressure controller may control a pressure control valve.

The system may include a combiner which combines the modulation frequency signal with at least one of a predetermined optimum value of feed pressure or rotation pressure prior to the feed pressure or rotation pressure being applied to the pressure control valve or flow control valve.

The controller may set a predetermined rotation pressure for the flow control valve.

The predetermined rotation pressure may be fixed for a drilling operation based on material being drilled and the drilling apparatus type for example.

The system may include a plurality of valves for controlling rotation feed pressure.

Preferably the pressure control valve controls a ram such as a hydraulic or pneumatic ram.

According to another embodiment the system includes a control chain or electric motor for applying feed pressure and rotational pressure.

The controller may include a low pass filter which filters data received from the rotation pressure sensor.

The controller preferably includes increasing or decreasing the feed pressure applied to the drilling apparatus.

The controller may periodically set a predetermined feed pressure by increasing or decreasing the previous feed pressure applied so that it is closer to a determined optimum feed pressure.

The increase or decrease preferably comprises an incremental value which lies within a range of values above and below the determined optimum value.

Preferably the incremental value is constant.

Alternatively the incremental value changes each time the controller receives data relating to the feed pressure.

Alternatively the incremental value changes each time the controller receives a signal from the rotation pressure sensor and/or feed pressure sensor.

The controller may periodically determine the rotation pressure and feed pressure of the drilling apparatus.

Preferably the controller periodically determines the rotation pressure and feed pressure of the drilling apparatus from the rotation pressure and feed pressure sensors.

The controller may include a processing means which collates rotation pressure and feed pressure from sensors and compares these with predetermined optimum values of rotation pressure and feed pressure for an optimum penetration rate for the drilling apparatus.

The predetermined optimum preferably includes an upper and lower limit for operating the drilling apparatus.

The predetermined optimum may be determined as a half way point between upper and lower limits.

The processing means preferably includes a module comprising hardware and/or software which outputs a new predetermined feed pressure and/or rotation pressure.

The new predetermined feed pressure and/or rotation pressure may be combined with the modulating frequency signal.

Preferably the amplitude of the modulating signal is constant and less than 15% of the actual feed pressure or rotation pressure. Alternatively it is half of the difference between the upper and lower limits.

The modulating frequency signal may be a sine or cosine function.

The rotation pressure at any time t may be determined by the formula:

$$\text{Rotational Pressure}=RP+R_p \sin(\omega t+\theta)$$

Where RP=mean rotation pressure level $R_p$=modulating rotation pressure amplitude And $\sin(\omega t+\theta)$ is the modulating sine wave at frequency $\omega$ where $\theta$ is an arbitrary phase delay. The frequency $\omega$ may be 0.5 Hz Preferably demodulation of the rotation pressure signal is performed by the controller and includes using the rotation pressure signal sensed to construct a unity amplitude wave in phase with the rotation pressure signal.

According to one embodiment the unity amplitude sine wave in phase with the rotation pressure is constructed by multiplying a unity amplitude sine wave by a rotation pressure pulse and taking the mean.

According to another aspect of the present invention there is provided a controller for a drilling apparatus comprising an optimum penetration rate module which is configured to store data relating to an optimum penetration rate for a drilling apparatus based on feed pressure and/or rotation pressure applied by the drilling apparatus, an input configured to receive a sensed signal with data relating to at least one of the rotation pressure and feed pressure sensed by sensors coupled to the drilling apparatus, a processor which collates the sensed data and demodulates a modulation signal in the sensed signal to determine the rotation pressure and/or feed pressure and increments the rotation pressure and/or feed pressure to output an incremental value for rotation pressure and/or feed pressure which is closer to an optimum rotation pressure and/or feed pressure required to optimise the penetration rate and an output which outputs the incremental value for rotation pressure and/or feed pressure to control the drilling apparatus.

It is preferred that the module includes hardware and/or software.

The input may be configured to receive a sensed rotation pressure signal which includes a modulation frequency of a predetermined amplitude.

It is preferred that modulation frequency is the same modulation frequency applied to the feed pressure actuator of the drilling apparatus.

The optimum penetration rate module may store data relating to graphical relationships between penetration rate versus feed pressure and feed pressure versus rotation pressure.

It is preferred that the module determines an optimum feed pressure for different drilling apparatuses, material being drilled and any other factors affecting the optimum penetration rate.

The processor may utilise optimising algorithms to determine optimum feed pressure and/or rotation pressure from sensed data.

The processor may utilise a demodulation algorithm having any of the features previously or hereinafter described.

According to one embodiment of the present invention the controller includes an output configured to be connected to a pressure control valve of a drilling apparatus.

According to another embodiment of the invention the controller includes an output connected to a combiner which combines a modulation frequency signal with the feed pressure signal output from the controller.

According to one embodiment the controller includes the combiner.

Preferably different material types being drilled include minerals, rock and any other substance.

Preferably references to feed force and rotational force and rotational torque include feed pressure or rotational pressure or any other variable including a force component.

BRIEF DESCRIPTION OF THE DRAWINGS

A preferred embodiment of the present invention will now be described by way of example only with reference to the accompanying drawings in which.

DETAILED DESCRIPTION OF THE DRAWINGS

Figure 1:
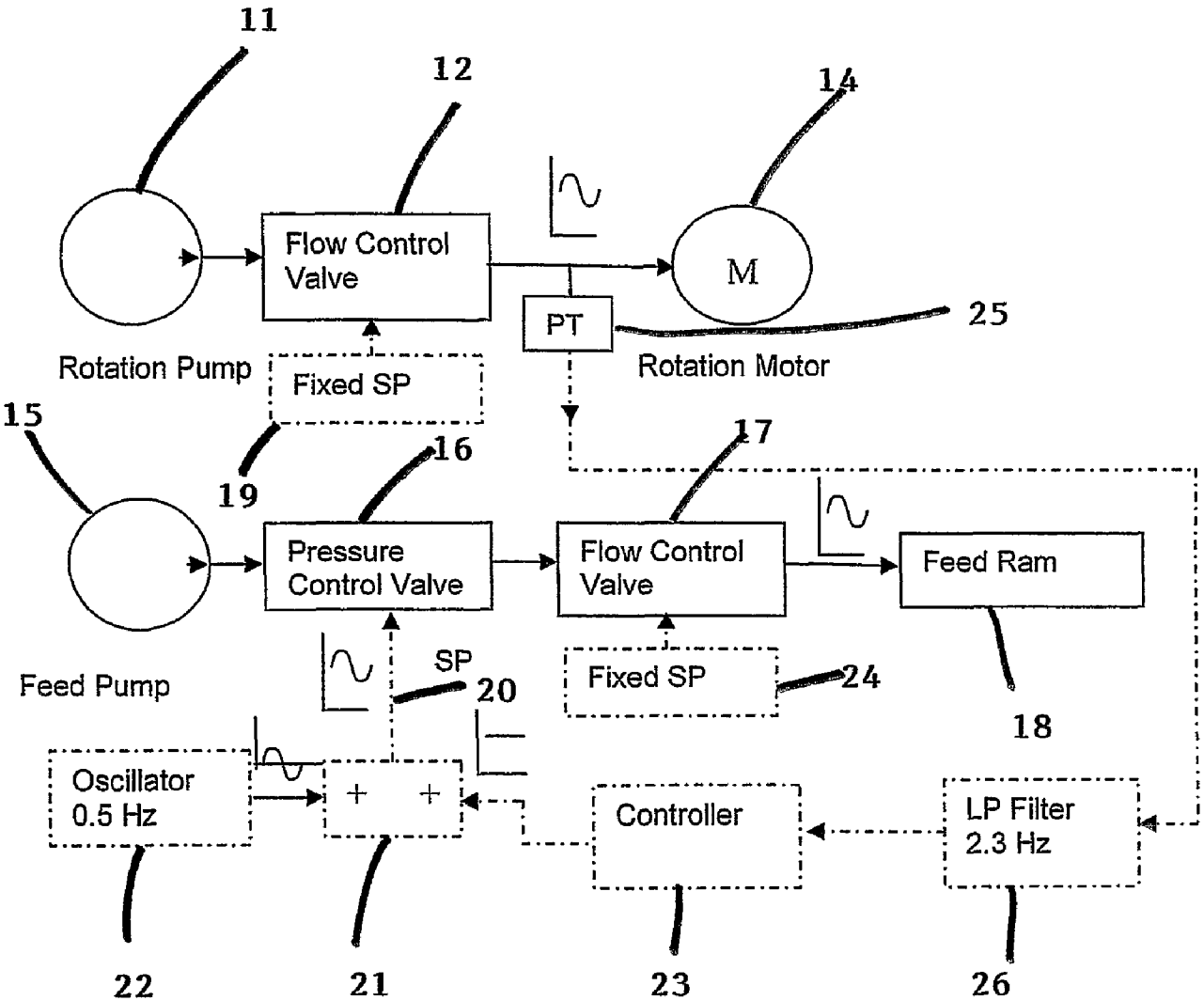
FIG. 1 shows a schematic of a control system for a drilling apparatus according to a preferred embodiment of the present invention.

As shown in FIG. 1 a drilling apparatus is shown with a rotation pump 11, flow control valve 12 and rotation motor 14. In addition the drilling apparatus has a feed pump 15, pressure control valve 16, flow control valve 17 and feed ram 18.

The system for controlling operation of the drilling apparatus consists of an input 19 to the flow control valve, an input 20 to the pressure control valve, which is the output from a combiner 21 having inputs from an oscillator 22 and a controller 23.

An input 24 is provided to the flow control valve 17. Alternatively an on/off value could be used.

An hydraulic pressure transducer 25 senses rotation pressure and is connected to controller 23 through a low pass filter 26.

The control system shown in FIG. 1 controls the drill feed pressure of the drilling apparatus to produce as close to an optimum drilling operation as possible. In the preferred embodiment optimum drilling is dependent upon which parameters are to be optimised. Some of the parameters include drilling at the maximum penetration rate, drilling holes as minimum deviation from the proposed path and drilling so as to obtain the maximum economic value of the equipment. Factors affecting drill operation include the properties of the material being drilled, equipment condition, clearing of drill cuttings and equipment capability.

In the preferred embodiment the diagram shown in FIG. 1 relates to control of a percussive drilling apparatus in hard rock mining using a "top hole" type drill.

In percussive drill in hard rock mining, penetration is achieved by the repeated application of a large impulsive force to a rock drill bit.

The drill bit is rotated to a suitable point after each impact and rock particles are cleared from the drilling area by air or water flushings with or without additives.

Drill bits for percussive drilling typically consist of a cylindrical surface with button like projections which are in direct contact with the rock.

The projections are made of a wear resistant material. When the bit is loaded the projections crush and crack the section of rock in which they are in contact.

To operate a percussive type drill, there are a number of requirements. These include:

- percussive pressure to provide the impact force and impact frequency;
- a feed force to keep the bit in contact with the rock;
- a rotation torque to turn the bit;
- a flushing medium to carry debris away from the front of the bit.

These services are provided by the drill.

Drills can be "top hole" type, where the drill is positioned outside the hole and contacts the drill bit via drill strings or "in the hole" type where the drill is positioned in the hole and closely attached to the drill bit.

The control system shown in FIG. 1 is based on observed relationships between rotation pressure/feed pressure and penetration rate/feed during drilling operations.

The feed pump 15 operates feed ram 18 and the feed pressure/force applied by the ram is controlled by pressure control valve 16 and flow control valve 17. Thus when both valves 16, 17 are fully open the hydraulic ram 18 provides maximum feed force to push the rock drill into the rock.

The rotation pump 11 drives a hydraulic motor 14 which provides rotation torque to rotate the rock drill bit. Flow control valve 12 controls the speed/torque applied to the motor 14 by the rotation pump 11. With the flow control valve 12 fully open the motor 14 operates at maximum rotation torque.

The feed force is directly proportional to the hydraulic pressure in the feed force ram and the rotation torque is directly proportional to the hydraulic pressure of the rotation motor. The pressure transducer 25 obtains rotation pressure readings applied to motor 14 while a feed pressure transducer (not shown) is able to provide data on the feed pressure applied by the feed ram 14.

Figure 2:
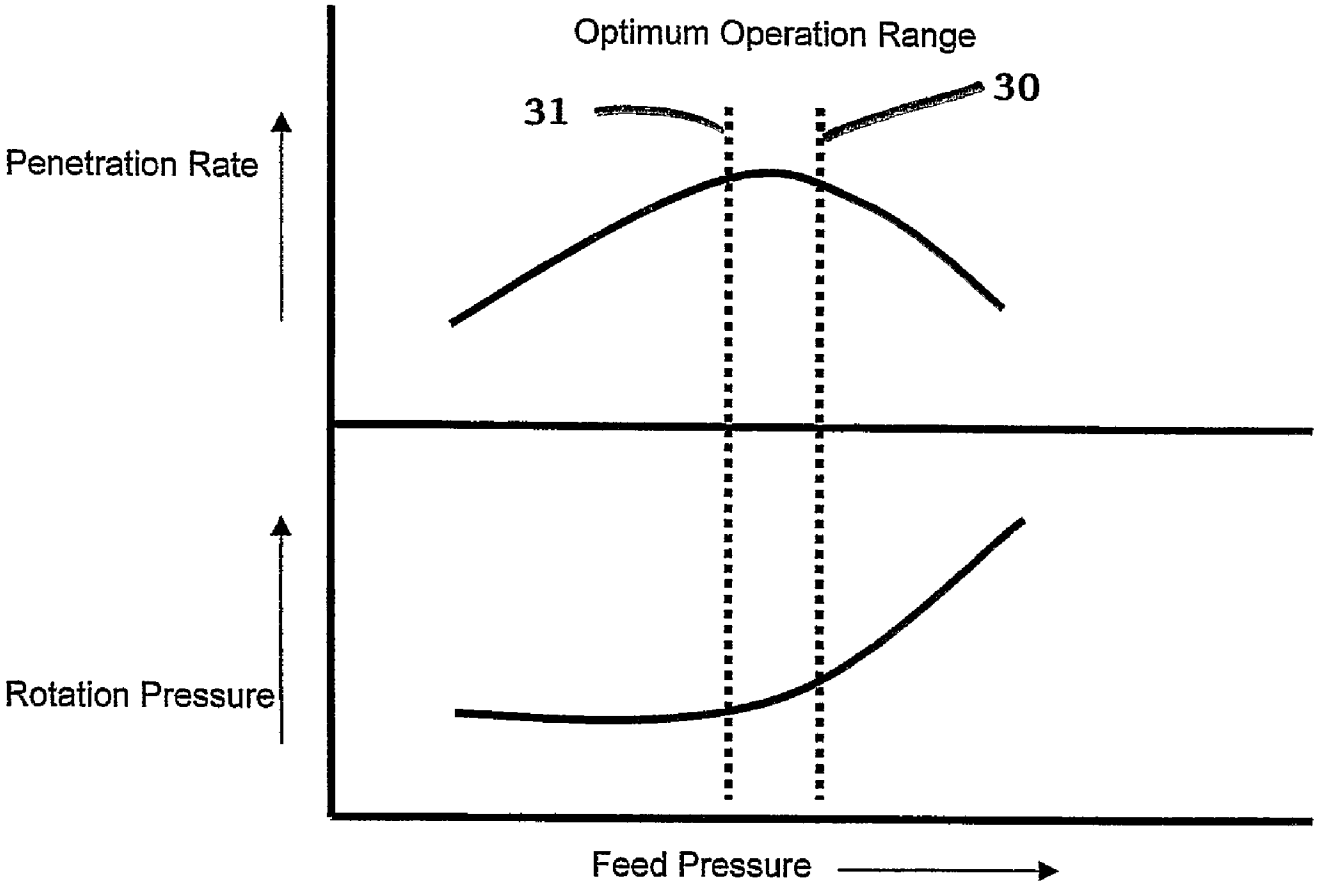
FIG. 2 shows graphical representations of rotation pressure and penetration rate as a function of feed pressure.

FIG. 2 shows a plot of rotation pressure and penetration rate as a function of feed pressure during a percussive hard rock drilling operation. The graphical plot shown in FIG. 2 indicates that the knee of the rotation pressure/feed pressure curve occurs at the feed pressure level at which the penetration rate is a maximum value. The level of feed pressure corresponding to the knee of the curve is the value required to achieve optimum drilling when penetration rate is the optimising parameter.

To achieve real time control would require the generation of these curves during drilling to allow real time adjustment of drilling parameters to suit rock conditions and drill set up. This is not feasible due to the time required and the practicality of continually changing feed pressure levels to enable the curves to be generated.

In accordance with the preferred embodiment a low frequency, low amplitude cyclically varying pressure signal is supplied by oscillator 22 to the controlling pressure control valve 16. This pressure signal is applied in the form of a modulation signal from oscillator 22 to a combiner 21. A starting feed pressure applied by the controller is also input to combiner 21 and combined with the modulation signal to provide a set point or starting value for the feed pressure for the pressure control valve 16.

The modulation signal has a set frequency of 0.5 Hz and therefore the feed pressure applied to feed ram 18 will have a constant pressure fluctuation appearing on top of the base feed pressure signal derived from controller 23. Because the rotation pressure is affected by the feed pressure as shown by the relationship shown in FIG. 2, the pressure fluctuations appearing on the feed pressure signal are also observed on the rotation pressure signal applied to the motor 14.

The rotation pressure/feed pressure shown in FIG. 2 indicates that the slope of the curve above the knee is an order of magnitude greater than the slope below the knee. In other words the gradient of the curve above the knee is much greater than the gradient below the knee. In other words below the knee the rotation pressure remains relatively constant as feed pressure is increased. Above the knee rotation pressure increases with the feed pressure. It follows that the resultant rotation pressure pulse will significantly increase amplitude when the feed pressure is increased from a low level to an optimum operation level and beyond.

The knee of the rotation pressure/feed pressure curve can be seen as a maximum point of a curve plotted from penetration rate against feed pressure. It is clear however from both plots shown in FIG. 2 that there is an optimum range defined by an upper feed pressure limit 30 and a lower feed pressure limit 31. The controller shown in FIG. 1 therefore periodically resets the set point pressure for the pressure control valve to maintain the feed pressure between the upper and lower limits 30, 31. The oscillator 22 is set at a frequency which allows a sampling rate which minimises noise interference and allows the controller to change the feed pressure applied by the pressure control valve allowing for the responsiveness of electronics and mechanical components controlling the feed pressure and rotation pressure respectively.

The control system shown in FIG. 1 therefore provides an example of one way of controlling a drilling apparatus by applying a modulation signal to the feed pressure and sensing the modulation signal on the rotation pressure sensed by the pressure transducer 25.

Initially the drill rotation motor 14 is controlled by valve 12 which is an electro/hydraulic flow control valve. The rotation pressure of the valve 12 is set at a fixed set-point based on initialising data having regard to the drilling apparatus, the material being drilled and the pre-determined optimum rotation pressure.

The feed ram 18 is controlled by valves 16 and 17. Valve 17 is an electro/hydraulic flow control valve which has a fixed set point based on initialising data to optimise the feed pressure value for the feed ram 18.

In addition valve 16 is an electro/hydraulic pressure control valve and controls the pressure level of the feed ram 18.

The initial set point 20 for the valve 16 is the sum total of the 0.5 Hz sine wave from oscillator 22 and a value calculated by the controller 23. This results in a 5 bar cyclic feed pressure variation being applied to the pressure level output from controller 23.

The controller 23 receives data on the levels of rotation pressure from pressure transducer 25 and optionally feed pressure measured by a feed pressure transducer (not shown). The sensed signals are filtered by the low pass filter 26 at a cut-off frequency of 2.3 Hz before being input to the controller 23.

The controller implements a demodulation algorithm to extract the rotation pressure pulse which has the modulation frequency signal induced on it as a result of the dependency relationship between rotation pressure and feed pressure as shown in the graphical representation shown in FIG. 2.

The value of the rotation pressure which is calculated from the demodulation algorithm, indicates whether feed pressure needs to be increased or decreased to optimise the value of rotation pressure and thus optimise the penetration rate. It should be noted that an alternative way of analysing the data is to apply the modulation signal to the rotation pressure and keep the rotation pressure within upper and lower limits and consequently monitor the pressure pulse or modulation signal appearing on the feed pressure signal.

As the modulating frequency determines the required sampling rate, the sampling rate is set at least 20 times the modulation frequency to ensure it can be detected above noise levels. The modulation frequency is determined by the time constants of the drill control systems. According to one example the drill on which tests were carried out had a dead time of 0.2 seconds and a time constant of 0.75 seconds. Hence the modulation frequency was set at 0.5 Hz. A faster control system would use a higher modulation frequency. The modulation frequency signal applied by oscillator 22 can be represented by $F_p$ sine(ωt+θ):

where $F_p$=the amplitude of the modulation frequency signal;

ω=the frequency of the modulation signal; and

θ=the phase of the modulation frequency signal.

As the controller provides a feed pressure value which closely approximates the optimum value, this value FP is combined with the modulation frequency signal to give the set point for pressure control valve 16 and results in the expression FP+$F_p$ sine(ωt+θ).

As the modulation signal also appears on the rotation pressure level, the pressure transducer 25 detects a rotation pressure signal represented by RP+$R_p$ sine(ωt+θ) where:

RP=mean rotation pressure level;

$R_p$=modulating rotation pressure pulse amplitude; and sine(ωt+θ) is the modulating sine wave at 0.5 Hz.

To extract the rotation pressure pulse amplitude the rotation pressure signal is demodulated using the following technique.

1. Remove RP from the rotation pressure signal by taking away the mean as showing in the following equation:

$$RP+R_p\sin(\omega t+\theta)-\overline{RP+R_p\sin(\omega t+\theta)}=R_p\sin(\omega t+\theta)$$

2. Construct a unity amplitude sine wave in phase with the rotation pressure pulse wave described below:

P Multiply a unity amplitude sine wave by the rotation pressure pulse and take the mean.

$$\overline{\sin(\omega t)\times R_p\sin(\omega t+\theta)}=\frac{R_p}{2}\cos(\theta)$$

Multiply a unity amplitude cosine wave by the rotation pressure pulse and take the mean:

$$\overline{\cos(\omega t)\times R_p\sin(\omega t+\theta)}=\frac{R_p}{2}\sin(\theta)$$

Use the results above to calculate θ:

$$\arctan\left(\frac{\frac{R_p}{2}\sin\theta}{\frac{R_p}{2}\cos\theta}\right) = \theta$$

The unity amplitude sine wave in phase with the pressure pulse is:

$$\sin(\omega t+\theta).$$

3. The rotation pressure pulse height can be calculated by demodulating the cyclic pressure signal with the in phase unity amplitude sine wave:

$$2\times\overline{\sin(\omega t+\theta)\times R_p\sin(\omega t+\theta)} = 2\times\frac{R_p}{2}\cos(0) = R_p$$

Once the value of $R_p$ has been determined by the controller 23 an incrementing algorithm can be utilised or alternatively control electronics can be utilised to produce a new value for FP. The amplitude of the rotation pressure pulse $R_p$ is then combined with the rotation pressure level which is fixed to determine the resulting rotation pressure. As the relationship between the rotation pressure and feed pressure is already known for the fixed parameters of the drilling apparatus and material being drilled, gradient values from the rotation pressure/feed pressure curve are used to back calculate the required feed pressure pulse height to achieve the detected level of rotation pressure pulse. The controller then increments the feed pressure level in accordance with the method steps set out as follows:

1. Set hydraulic feed pressure level at 30 bar.
2. Demodulate rotation pressure pulse height every 2 seconds.
3. If rotation pressure pulse <30 bar increase feed pressure by 5 bar.
4. If rotation pressure pulse >30 bar decrease feed pressure by 5 bar.
5. Output new feed pressure level to combiner 21.
6. Continuously repeat program to maintain feed pressure in the optimum drilling range.

The method steps may be implemented by hardware in the form of controlling electronics or may be a controlling algorithm in software which is able to output the feed pressure level.

It should be noted that the amplitude of the modulation frequency is selected by the gradient and the noise level. In experiments which have been performed the resulting rotation pressure pulse was required to have an amplitude greater than 20 bar when drilling above the knee of the rotation pressure/feed pressure curve for a modulation frequency of 0.5 Hz.

Figure 3:
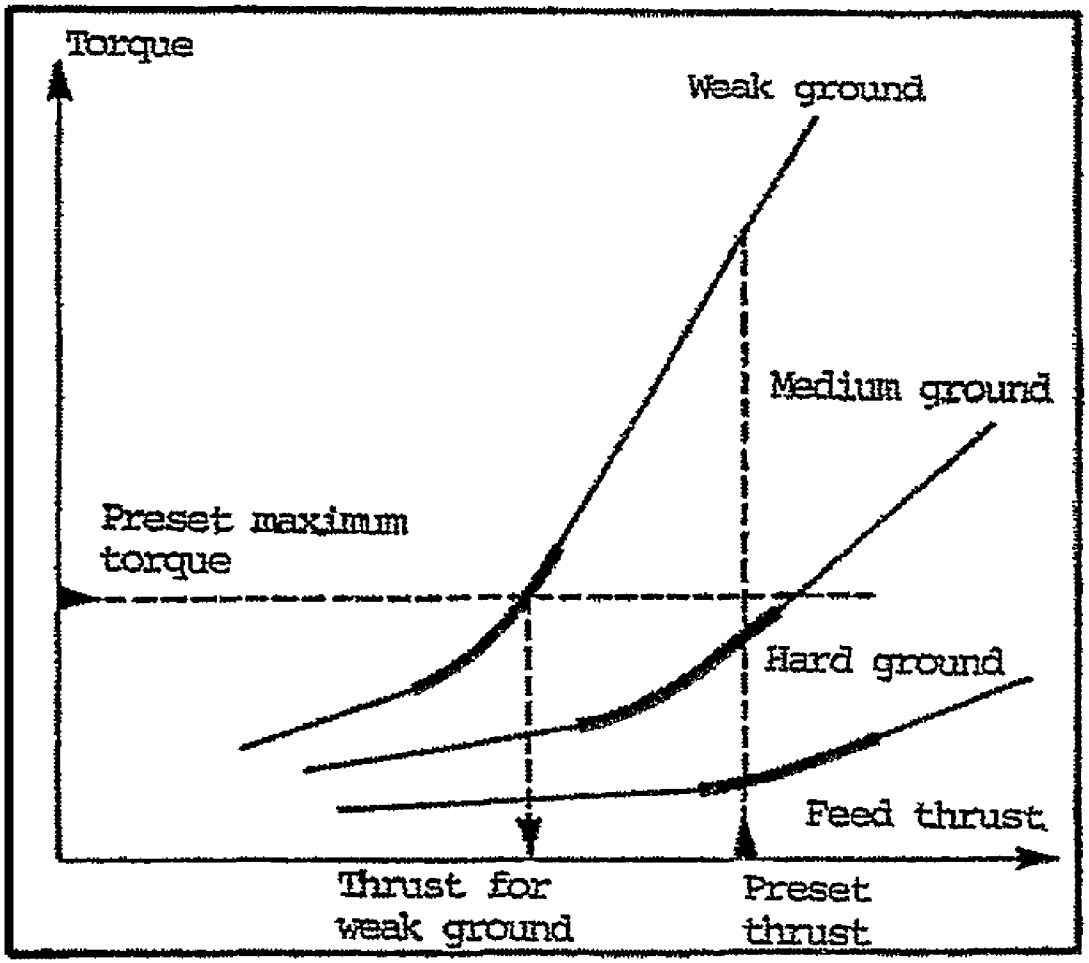
FIG. 3 shows a graphical representation of rotation pressure versus feed pressure for week, medium and hard rock.

According to one embodiment of the present invention the controller stores graphical data relating to the aforementioned rotation pressure, feed pressure and penetration rates for different types of rock types as illustrated in FIG. 3. This figure shows how the gradient changes for different rock types in a plot of torque (rotation pressure) as a function of thrust (feed pressure). Thus as shown the harder the rock type the lower the gradient.

Figure 4:
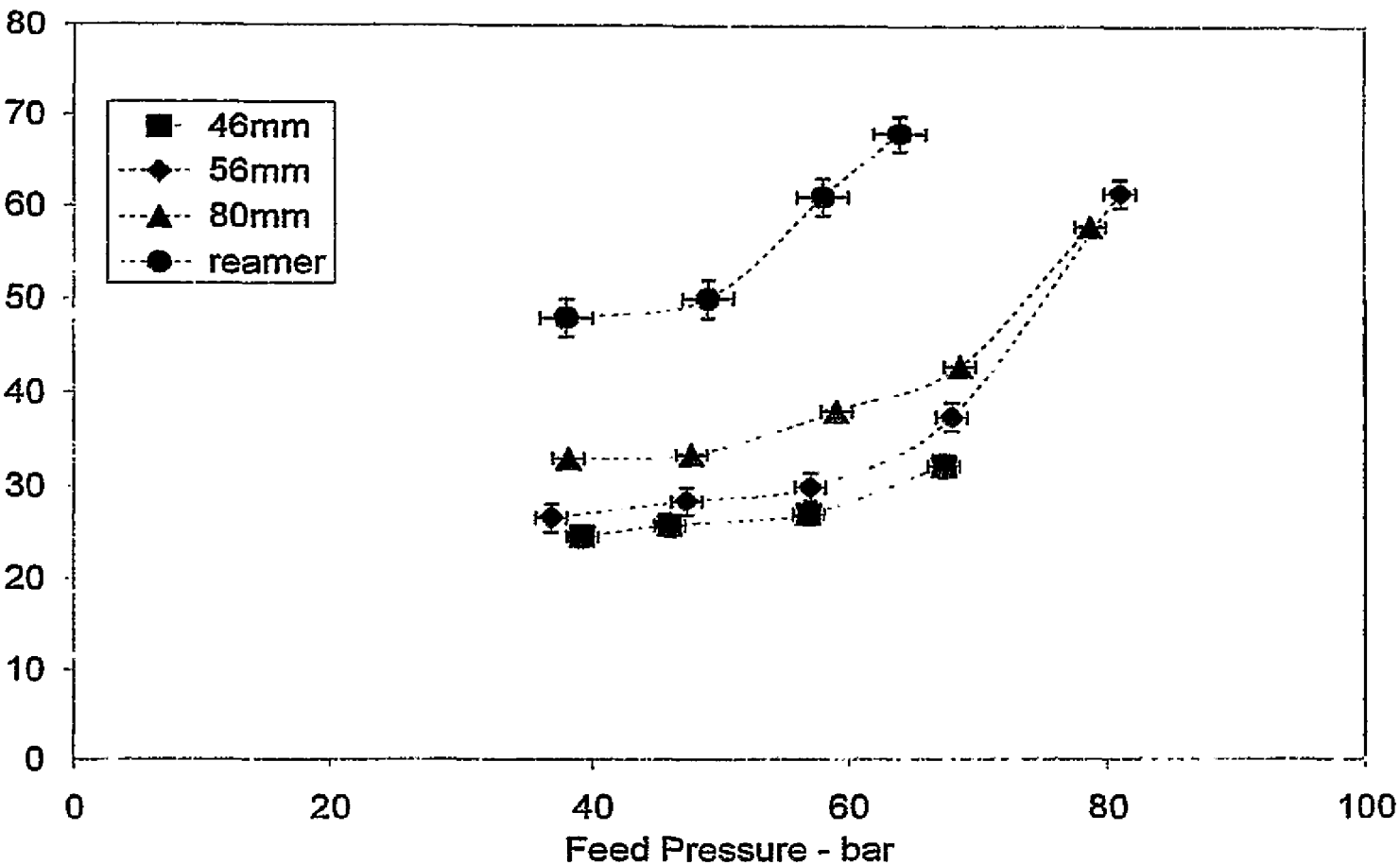
FIG. 4 shows a graphical representation of rotation pressure as a function of feed pressure for a selection of drill bits.

In addition for different sized drill bits used for drilling the same type of rock, FIG. 4 shows a relatively constant gradient for different sized drill bits.

Further experimentation also shows how there is a relatively constant gradient above the knees of curves of rotation pressure versus feed pressure for different numbers of drill strings used in a drilling apparatus used in the same type of rock.

In the controller the graphical data can be stored as an equivalent mathematical representation which allows easier feedback control of the feed pressure using the system outlined above. In accordance with one embodiment where a drilling apparatus is used on hard rock, the only parameters that need to be preset are the maximum and minimum limits on the feed and rotation pressures. Therefore the controller continually increments the value for feed pressure in accordance with the previous system to ensure that the feed pressure level is optimised between the upper and lower limits.

In the aforementioned case, the optimised feed pressure or rotation pressure so found for the drilling apparatus in use provides a measure of the drilling characteristics of the rock. As the drill moves from one rock type to another the controller will determine new optimised drilling pressures and such pressures provide a measure of the rock type which is useful information for design and management of mines. For this example, this information may be used to indicate when the drill has crossed the boundary between ore and waste.

In situations where the gradient of the rotation pressure/feed pressure curves changes significantly based on drill set up and rock conditions, the controller would be set up to monitor parameters relating to the drill apparatus and rock conditions and relate these back to stored graphical/mathematical models so that the controller can determine preferred upper and lower limits for each set of parameter values.

It is to be understood that, if any prior art publication is referred to herein, such reference does not constitute an admission that the publication forms a part of the common general knowledge in the art, in Australia or in any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method for controlling drilling apparatus comprising the steps of applying a rotation force to a drilling part of the drilling apparatus, applying a feed force to the drilling part with the feed force comprising a predetermined modulating frequency signal and predetermined feed force, storing data in a controller relating to optimum feed force and rotation force for a predetermined material being cut and for a given type of drilling apparatus or part of the drilling apparatus, wherein optimum predetermined feed force is determined periodically from sensed data relating to at least one of the rotation force and feed force to optimize the penetration rate of the drilling apparatus, and further comprising the step of sampling the rotation force at a sampling rate greater than a modulation frequency.

2. A system for controlling a drilling apparatus comprising a rotation pressure sensor to sense rotation pressure on the drilling apparatus, a feed pressure sensor to sense feed pressure on the drilling apparatus, a controller which controls at least one of the rotation pressure or feed pressure applied to the drilling apparatus and a modulating means which applies a predetermined modulating frequency signal to at least one of the rotation pressure and feed pressure, wherein the controller includes a demodulation algorithm for extracting either the rotation pressure from the rotation pressure sensor or the feed pressure from the feed pressure sensor, to alter the feed pressure and rotation pressure respectively, to optimise a penetration rate of the drilling apparatus.

3. The system as claimed in claim 2 wherein the controller determines the optimum feed pressure from the sensed rotation pressure.

4. The system as claimed in claim 2 wherein the rotation pressure sensor and/or feed pressure sensor has a sampling rate which is at least twenty times the modulating frequency.

5. The system as claimed in claim 2 further comprising a combiner which combines the modulation frequency signal with at least one of a predetermined optimum value of feed pressure or rotation pressure prior to the feed pressure or rotation pressure being applied to a pressure control valve or flow control valve.

6. The system as claimed in claim 2 wherein the modulating frequency signal comprises one of a sine or co-sine function.

7. The system as claimed in claim 2 wherein the rotation pressure at any time t is determined by a the formula:

$$\text{Rotational Pressure}=RP+R_p\sin(\omega t+\theta)$$

where RP=mean rotation pressure level $R_p$=modulating rotation pressure amplitude, and $\sin(\omega t+\theta)$ is the modulating sine wave at frequency $\omega$ where $\theta$ is an arbitrary phase delay.

8. The system as claimed in claim 2 wherein demodulation of the rotation pressure signal is performed by the controller and includes using the rotation pressure signal sensed to construct a unity amplitude wave in phase with the rotation pressure signal.

9. The system as claimed in claim 8 wherein the unity amplitude wave comprises a sine wave in phase with the rotation pressure and is constructed by multiplying a unity amplitude sine wave by a rotation pressure pulse and taking the mean.

10. The system as claimed in claim 2, wherein the feed pressure is demodulated, said demodulation being performed by the controller and including using the feed pressure signal sensed to construct a unity amplitude wave in phase with the feed pressure signal.

11. The system as claimed in claim 10, wherein the unity amplitude wave comprises a sine wave with the feed pressure and is constructed by multiplying a unity amplitude sine wave by a feed pressure pulse and taking the mean.

12. A method for controlling a drilling apparatus comprising the steps of applying a rotation force to a drillin part of the drilling apparatus, applying a feed force to the drilling part with the feed force comprising a predetermined modulating frequency signal and predetermined feed force, storing data in a controller relating to optimum feed force and rotation force for a predetermined material being cut and for a given type of drilling apparatus or part of the drilling apparatus, wherein optimum predetermined feed force is determined periodically from sensed data relating to at least one of the rotation force and feed force to optimize the penetration rate of the drilling apparatus, wherein the feed force is changed periodically by an incremental value and changes in at least one of the feed force and rotation force are monitored and referenced to predetermined data relating to different material types being drilled to determine at least one characteristic of the material being drilled.

13. The method as claimed in claim 12 wherein the controller outputs data on at least one material characteristic based on changes in sensed rotational or feed force.

14. A method for controlling a drilling apparatus comprising the steps of applying a feed force to a drilling part of the drilling apparatus, applying a rotation force to the drilling part with the rotation force comprising a predetermined modulating frequency signal and predetermined rotation force, storing data in a controller relating to optimum feed force and rotation force for a predetermined material being cut and for a given type of drilling apparatus or part of the drilling apparatus, wherein optimum predetermined rotation force is determined periodically from sensed data relating to at least one of the rotation force and feed force to optimize the penetration rate of the drilling apparatus, and further comprising the step of sampling the feed force at a sampling rate greater than a modulation frequency.

* * * * *